US007794148B2

(12) United States Patent
Derby et al.

(10) Patent No.: US 7,794,148 B2
(45) **Date of Patent: *Sep. 14, 2010**

(54) BULK BAG FOR DENSE MATERIALS

(75) Inventors: Norwin C. Derby, Greenville, TX (US); Craig Alan Nickell, Aledo, TX (US)

(73) Assignee: Super Sack Mfg. Corp., Dallas, TX (US)

( * ) Notice: Subject to any disclaimer, the term of this patent is extended or adjusted under 35 U.S.C. 154(b) by 1056 days.

This patent is subject to a terminal disclaimer.

(21) Appl. No.: 11/115,817

(22) Filed: Apr. 26, 2005

(65) Prior Publication Data

US 2005/0196079 A1 Sep. 8, 2005

Related U.S. Application Data

(63) Continuation-in-part of application No. 10/424,519, filed on Apr. 28, 2003, now abandoned, which is a continuation of application No. 10/020,827, filed on Dec. 11, 2001, now Pat. No. 6,565,256, which is a continuation-in-part of application No. 09/479,812, filed on Jan. 7, 2000, now Pat. No. 6,331,077.

(51) Int. Cl.
*B65D 33/02* (2006.01)
*B65D 33/00* (2006.01)

(52) U.S. Cl. ..... 383/119; 383/105; 383/903

(58) Field of Classification Search ..... 383/105, 383/119, 903
See application file for complete search history.

(56) References Cited

U.S. PATENT DOCUMENTS 1,338,776 A 5/1920 Jennings
5,071,025 A 12/1991 Boots
5,073,035 A * 12/1991 Williams ..... 383/19
5,076,710 A 12/1991 Derby
5,222,812 A 6/1993 Cuddy et al.
5,316,387 A * 5/1994 Polett et al. ..... 383/119
5,538,155 A 7/1996 Hoekstra
5,660,478 A * 8/1997 Alack et al. ..... 383/119
5,685,644 A 11/1997 Taylor ..... 383/903
5,797,491 A 8/1998 Fierek et al. ..... 383/38
6,012,266 A * 1/2000 Koskinen et al. ..... 53/399
6,015,057 A 1/2000 Stone et al.
6,203,198 B1 * 3/2001 Stone ..... 383/119
6,220,755 B1 * 4/2001 Brown et al. ..... 383/119
6,224,261 B1 * 5/2001 Stone ..... 383/119
6,328,470 B2 * 12/2001 Brown et al. ..... 383/119
6,331,077 B1 12/2001 Nickell ..... 383/119

(Continued)

FOREIGN PATENT DOCUMENTS

DE 004021504 A 1/1992 ..... 220/9.1

(Continued)

*Primary Examiner*—Jes F Pascua
(74) *Attorney, Agent, or Firm*—Klemchuk Kubasta LLP; Kelly J. Kubasta

(57) ABSTRACT

A bulk bag for dense materials includes side walls seamed together end-to-end to form a rectangular enclosure and at least a bottom wall secured to the lower ends of the side walls. Baffles are secured in the side wall seams and extend diagonally across the interior of the bulk bag to maintain the bulk bag in a rectangular cross-sectional configuration when filled with dense materials.

5 Claims, 11 Drawing Sheets

U.S. PATENT DOCUMENTS

| | | | | |
|---|---|---|---|---|
| 6,402,378 | B1 | 6/2002 | Shackleton | 383/119 |
| 6,565,256 | B2 | 5/2003 | Derby et al. | 383/119 |
| 7,163,337 | B2 * | 1/2007 | Penson | 383/38 |
| 2001/0016086 | A1 * | 8/2001 | Stone | 383/119 |
| 2001/0038722 | A1 * | 11/2001 | Stone | 383/119 |

FOREIGN PATENT DOCUMENTS

| | | | | |
|---|---|---|---|---|
| DE | 4115345 A1 | | 11/1992 | |
| GB | 1 544 631 A | * | 4/1979 | |
| JP | 4-44958 | | 2/1992 | 383/38 |
| WO | WO 92/14660 | | 9/1992 | |
| WO | PCT/IE96/00078 | | 12/1996 | |
| WO | PCT/IE99/00115 | | 11/1999 | |

* cited by examiner

Fig. 7
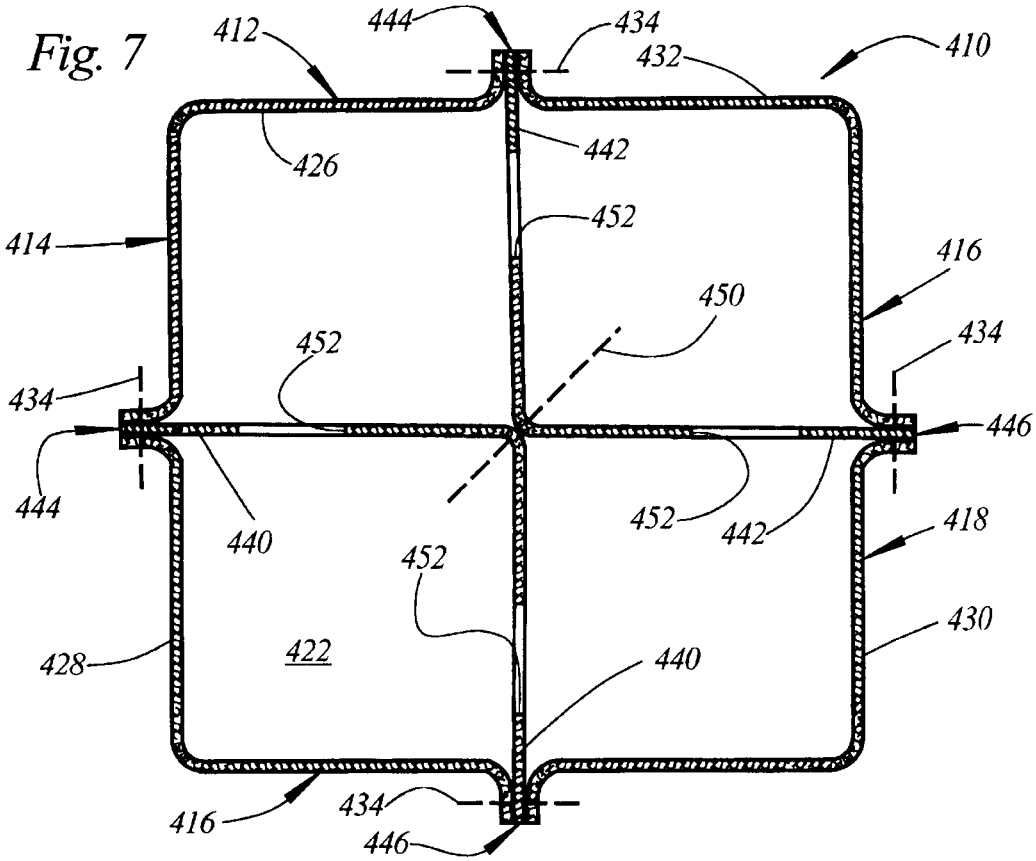
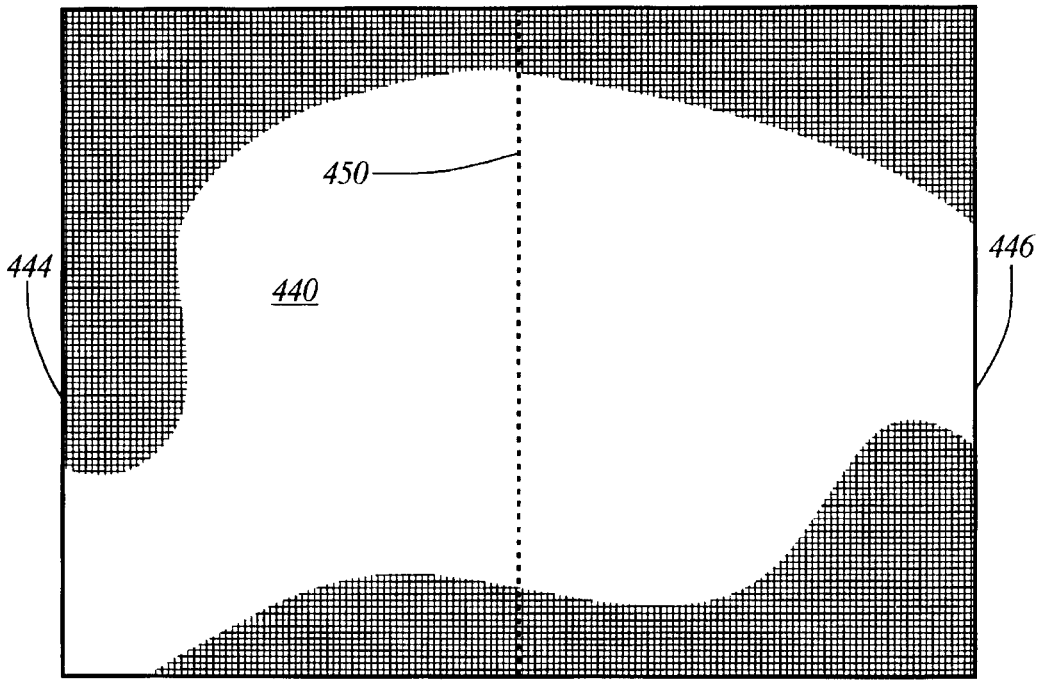
Fig. 8

Fig. 9
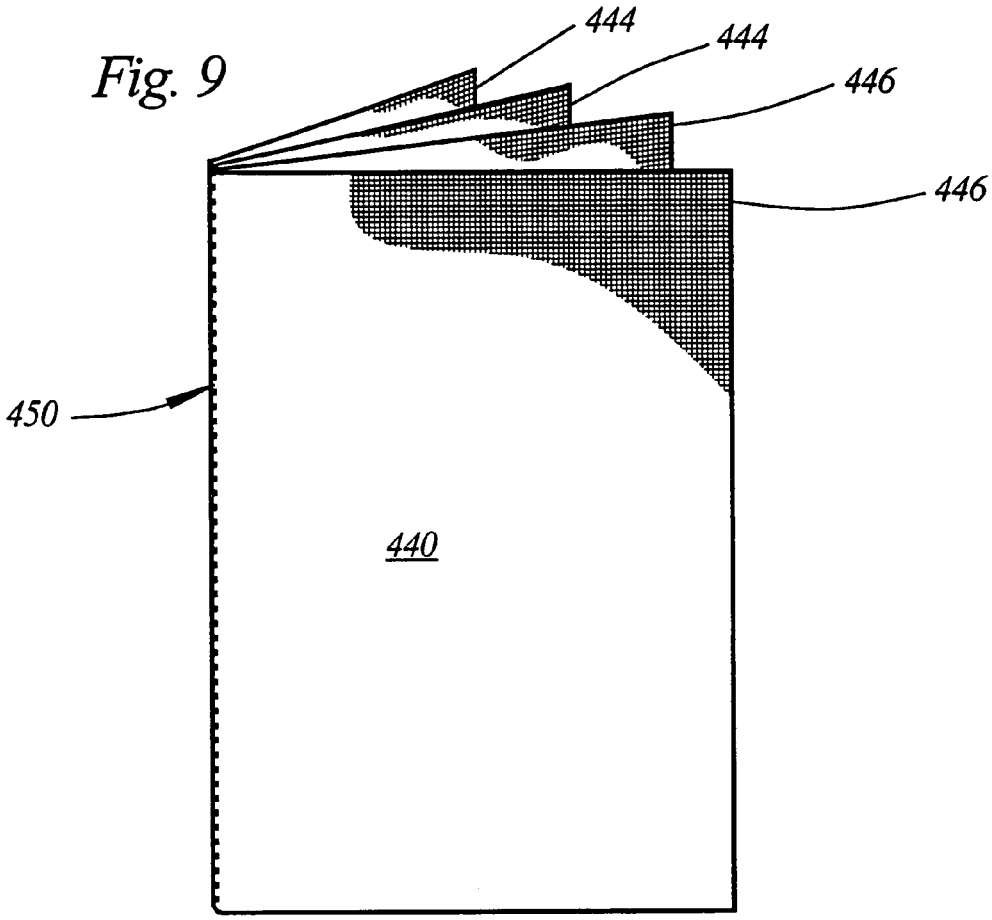
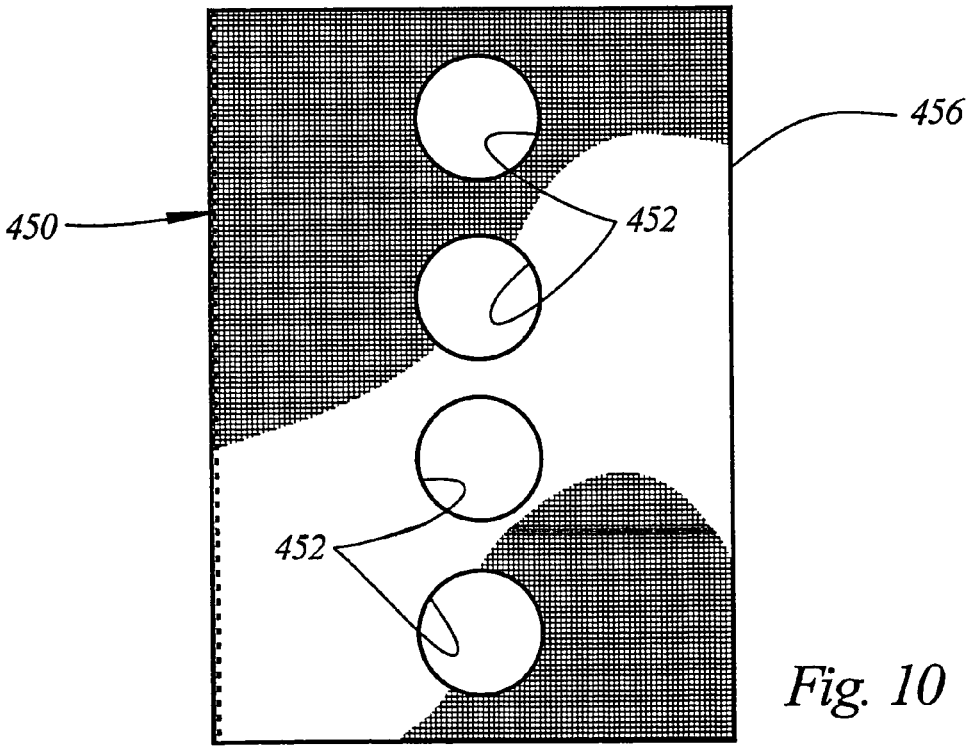
Fig. 10

BULK BAG FOR DENSE MATERIALS

CROSS-REFERENCE TO RELATED APPLICATIONS

This is a continuation-in-part application under 37 C.F.R. §1.63 of application Ser. No. 10/424,519 filed now abandoned Apr. 28, 2003, now abandoned; which is a continuation application of application Ser. No. 10/020,827 filed Dec. 11, 2001, now U.S. Pat. No. 6,565,256; which is a continuation-in-part application of application Ser. No. 09/479,812 filed Jan. 7, 2000, now U.S. Pat. No. 6,331,077.

TECHNICAL FIELD

The present invention relates generally to flexible intermediate bulk containers, also known as bulk bags, and more particularly to an improved bulk bag construction useful in the transportation, storage, and discharge of dense materials.

BACKGROUND OF THE INVENTION

Over the past three decades flexible intermediate bulk containers, commonly known as bulk bags, have gained increasing acceptance in the transportation, storage, and discharge of dry, flowable solids. Bulk bags are almost universally constructed from woven polypropylene panels which are joined along their adjacent edges by sewing. Although tubular bulk bag constructions are known, most of the present bulk bag designs are square or rectangular in horizontal cross section.

Because they are constructed from flexible fabrics, conventional bulk bag designs assume a cylindrical configuration when filled regardless of their original horizontal cross-sectional configuration. This is undesirable because cylindrical configurations cannot completely fill a square or rectangular vehicle or warehouse.

The foregoing problem is overcome by the bulk bag disclosed and claimed in the Derby Patent Number 5,076,710 issued Dec. 31, 1991, and assigned to the assignee hereof. As illustrated in FIGS. 1 and 2 hereof, the bulk bag of the Derby Patent employs side panels which are joined at seams located at spaced intervals relative to the corners of the bulk bag. Baffles extending across the corners of the bulk bag and secured to the side panels prevent the bulk bag from assuming a cylindrical configuration when filled.

The bulk bag of the Derby Patent operates satisfactorily when used in conjunction with relatively light materials. However, when used in conjunction with more dense materials, the bulk bag construction of the Derby invention is not entirely successful in maintaining a rectangular configuration when filled. Thus, a need exists for further improvements in the art of bulk bag design to provide a bulk bag which maintains a rectangular configuration even when filled with coins and other objects formed from relatively heavy metals.

The present invention comprises a bulk bag construction which fulfills the foregoing and other objectives long since found lacking in the prior art. In accordance with the broader aspects of the invention, a bulk bag constructed generally in accordance with the disclosure of the above-identified Derby Patent is provided with at least one additional panel extending between the side walls of the bulk bag. The use of the additional panel in the construction of the bulk bag prevents the side walls of the bulk bag from bulging outwardly when the bulk bag is filled with dense materials.

In accordance with more specific aspects of the invention, the bulk bag may be provided with either one or two panels extending between the side walls thereof. When two panels are used, the panels may be deployed either in a parallel configuration or in a perpendicular configuration.

BRIEF DESCRIPTION OF THE DRAWINGS

A more complete understanding of the present invention may be had by reference to the following Detailed Description when taken in connection with the accompanying Drawings wherein:

FIG. 7 is a transverse sectional view of a bulk bag comprising a fourth embodiment of the invention;

FIG. 8 is an illustration of a first step in a method of manufacturing the bulk bag of FIG. 7;

FIG. 9 is an illustration of an intermediate step in the method of FIG. 8;

FIG. 10 is an illustration of a later step in the method of FIG. 8;

DETAILED DESCRIPTION

Figure 1:
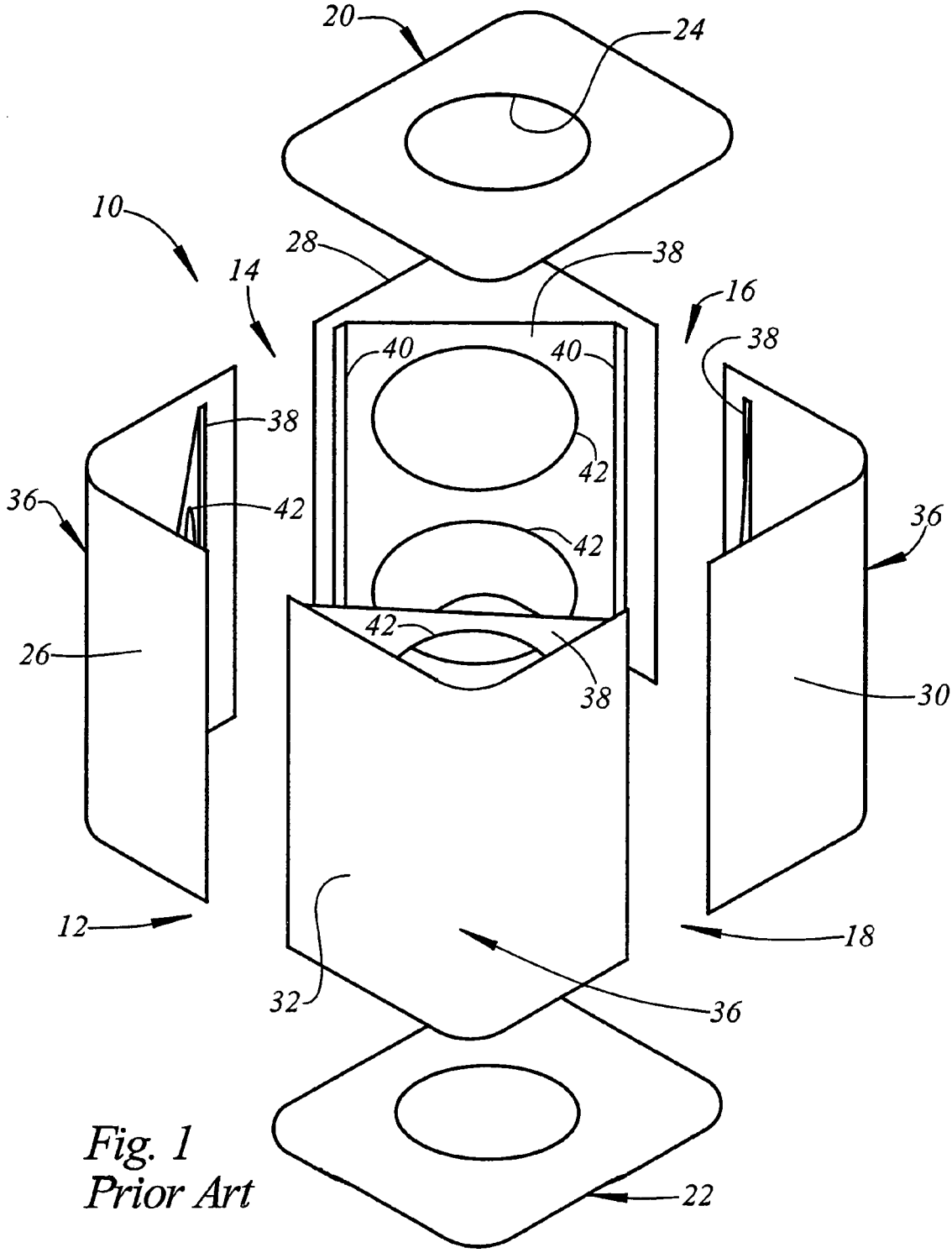
Fig. 1 Prior Art
FIG. 1 is an exploded perspective view of a prior art bulk bag.
Figure 2:
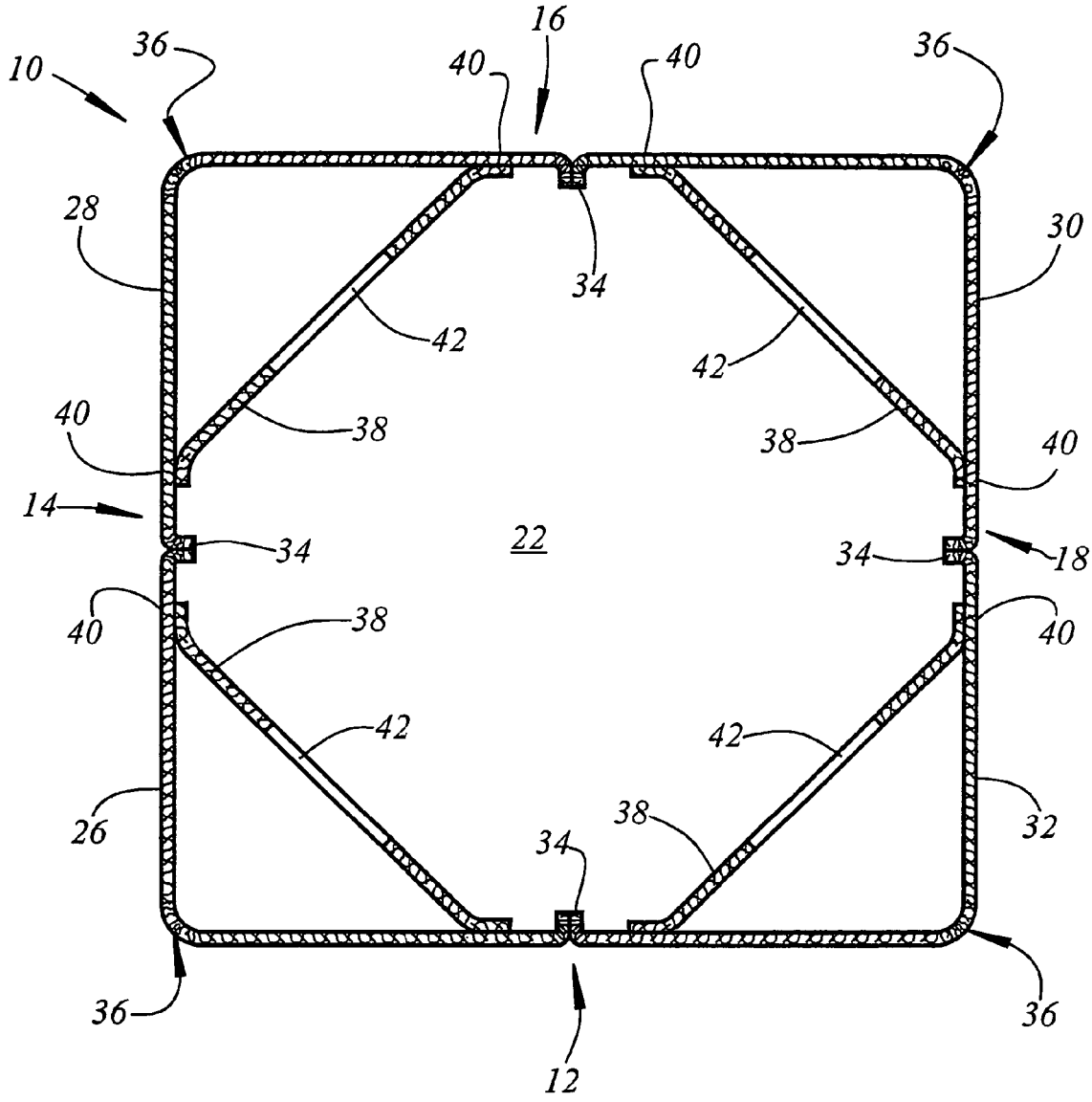
Fig. 2 Prior Art
FIG. 2 is a horizontal sectional view of the bulk bag of FIG. 1.

Referring now to the Drawings, and particularly to FIGS. 1 and 2 thereof, there is shown a bulk bag 10 constructed in accordance with the teachings of Derby Patent Number 5,076,710 granted Dec. 31, 1991, and assigned to the assignee hereof. The bulk bag 10 includes four side walls 12, 14, 16, and 18. The bulk bag 10 further includes a top wall 20 and a bottom wall 22 either of which may be provided with an aperture 24 which receives a fill spout in the case of the top wall 20 or a discharge spout in the case of the bottom wall 22.

The side walls 12, 14, 16, and 18 of the bulk bag 10 are formed from four side panels 26, 28, 30, and 32. The side panels 26, 28, 30, and 32 are joined one to another at seams 34 each of which is located in a spaced apart relationship to the corners 36 of the bulk bag 10. In the embodiment of the Derby invention illustrated in FIG. 2, the seams 34 are located at points equidistant from adjacent corners 36, however, other configurations can be used in the practice of the Derby invention, if desired.

Each of the side panels 26, 28, 30, and 32 is provided with a baffle 38. Each baffle 38 is secured to its respective side panel at points 40 by sewing. Each baffle 38 is provided with one or more apertures 42 which allow material received in the bulk bag to flow into the corners 36 thereof.

Figure 3:
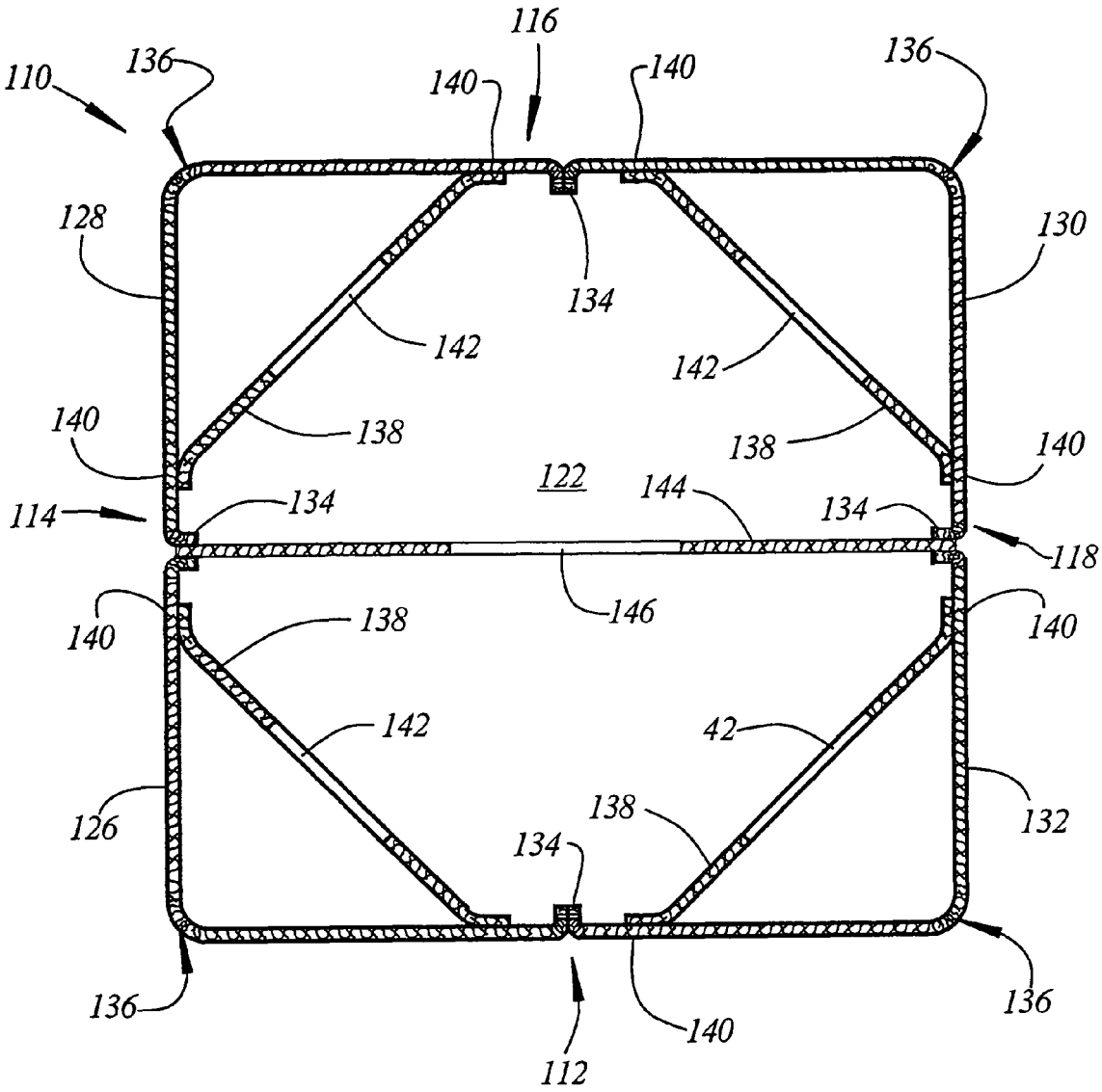
FIG. 3 is a horizontal sectional view of a bulk bag comprising the first embodiment of the present invention.

Referring now to FIG. 3, there is shown a bulk bag 110 comprising a first embodiment of the present invention. The bulk bag 110 includes four side walls 112, 114, 116, and 118. The bulk bag 110 further includes a bottom wall 122 and may include a top wall, although open top bulk bags are known. The top wall and the bottom wall may be provided with an aperture which receives a fill spout in the case of the top wall or a discharge spout in the case of the bottom wall.

The side walls 112, 114, 116, and 118 of the bulk bag 110 are formed from four side panels 126, 128, 130, and 132. The side panels 126, 128, 130, and 132 are joined one to another at seams 134 each of which is located in a spaced apart relationship to the corners 136 of the bulk bag 110. In the embodiment of the invention illustrated in FIG. 3, the seams 134 are located at points equidistant from adjacent corners 136, however, other configurations can be used in the practice of the invention, if desired.

Each of the side panels 126, 128, 130, and 132 is provided with a baffle 138. Each baffle 138 is secured to its respective side panel at points 140 by sewing. Each baffle 138 is provided with one or more apertures 142 which allow material received in the bulk bag to flow into the corners 136 thereof.

In accordance with the present invention, the bulk bag 110 is provided with a baffle 144 which extends between the seams 134 of the side walls 114 and 118. The baffle 144 is provided with an aperture 146 which allows material to flow between the opposite sides of the baffle 144 as the bulk bag 110 is filled. The baffle 144 prevents the side walls 114 and 118 of the bulk bag 110 from bulging outwardly when the bulk bag 110 is filled with dense materials, thereby preventing the bulk bag 110 from assuming a non-rectangular configuration when filled.

Figure 4:
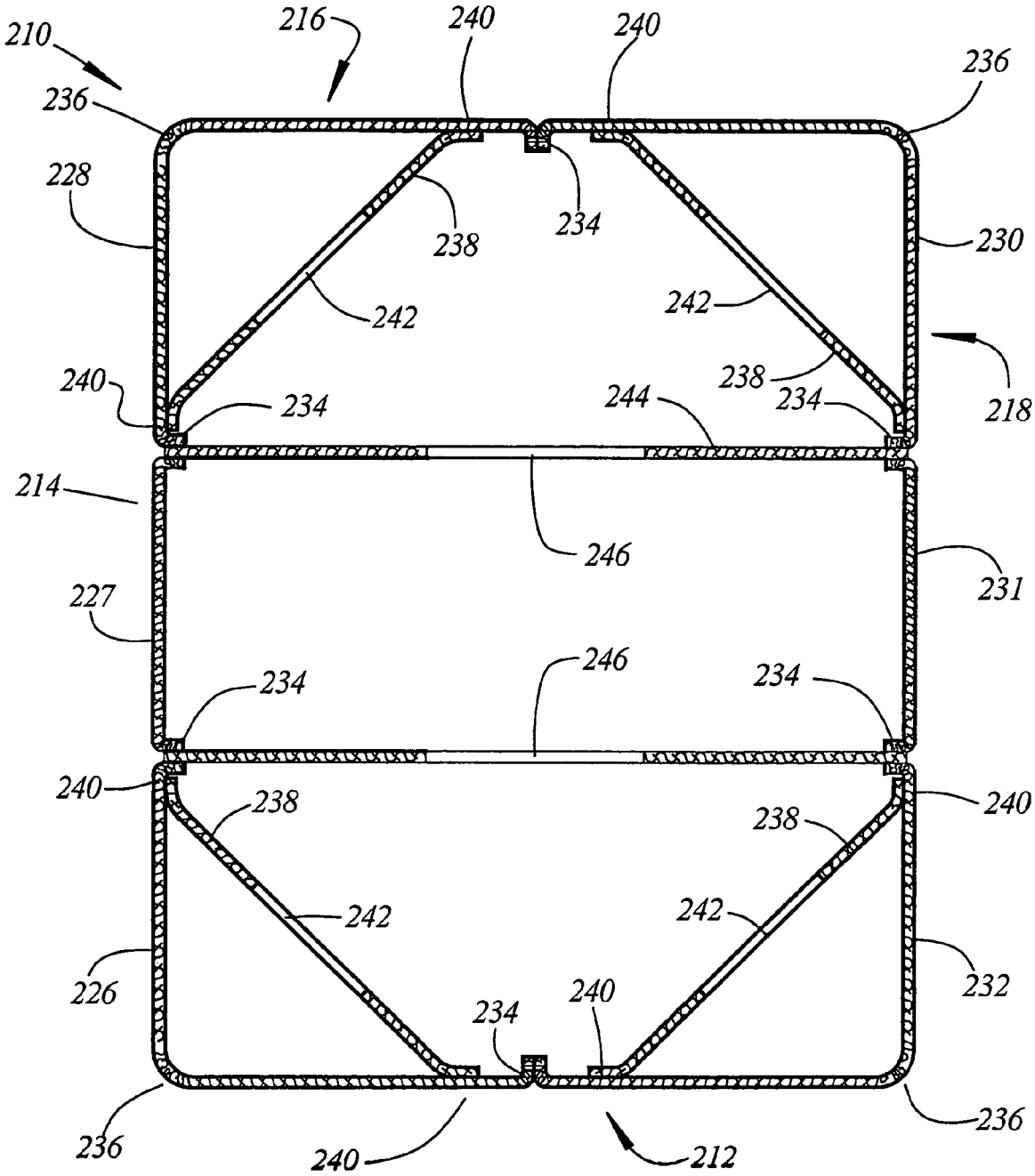
FIG. 4 is a horizontal sectional view of a bulk bag comprising a second embodiment of the present invention.

Referring now to FIG. 4, there is shown a bulk bag 210 comprising a second embodiment of the present invention. The bulk bag 210 includes four side walls 212, 214, 216, and 218. The bulk bag 210 further includes a top wall and a bottom wall 222 either of which may be provided with an aperture which receives a fill spout in the case of the top wall or a discharge spout in the case of the bottom wall.

The side walls 212, 214, 216, and 218 of the bulk bag 210 are formed from six side panels 226, 227, 228, 230, 231, and 232. The side panels 226, 227, 228, 230, 231, and 232 are joined one to another at seams 234 each of which is located in a spaced apart relationship to the corners 236 of the bulk bag 210. In the embodiment of the invention illustrated in FIG. 4, the side walls 214 and 218 which include the panels 227 and 231, respectively, are relatively longer than the side walls 212 and 216.

Each of the side panels 226, 228, 230, and 232 is provided with a baffle 238. Each baffle 238 is secured to its respective side panel at points 240 by sewing. Each baffle 238 is provided with one or more apertures 242 which allow material received in the bulk bag to flow into the corners 236 thereof.

In accordance with the present invention, the bulk bag 210 is provided with two baffles 244 which are secured in and extend between the seams 234 of the side walls 214 and 218. The baffles 244 are provided with apertures 246 which allow material to flow between the opposite sides of the baffles 244 as the bulk bag 210 is filled. The baffles 244 prevent the side walls 214 and 218 of the bulk bag 210 from bulging outwardly when the bulk bag 210 is filled with dense materials, thereby preventing the bulk bag 110 from assuming a non-rectangular configuration when filled.

Figure 5:
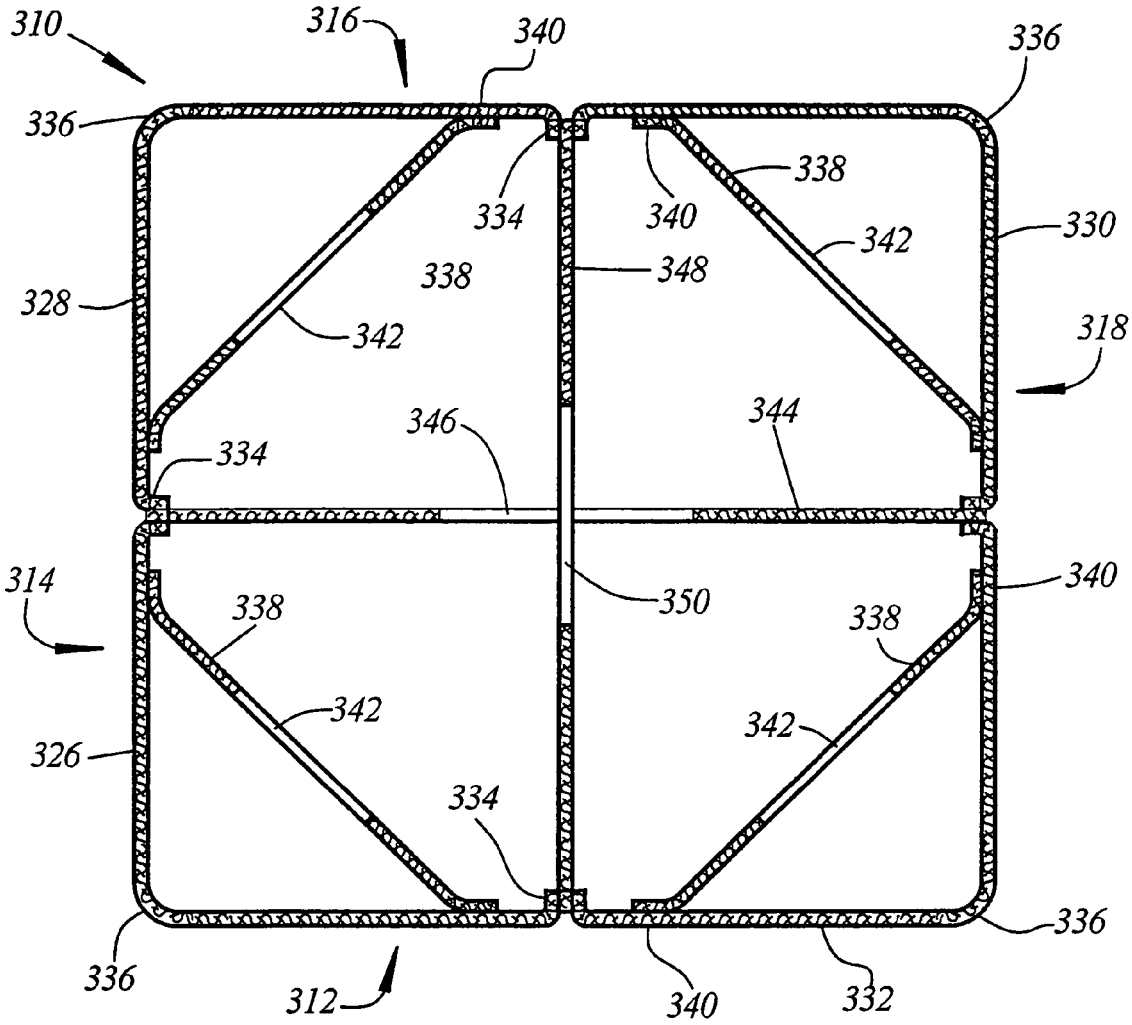
FIG. 5 is a horizontal sectional view of a bulk bag comprising a third embodiment of the present invention.
Figure 6:
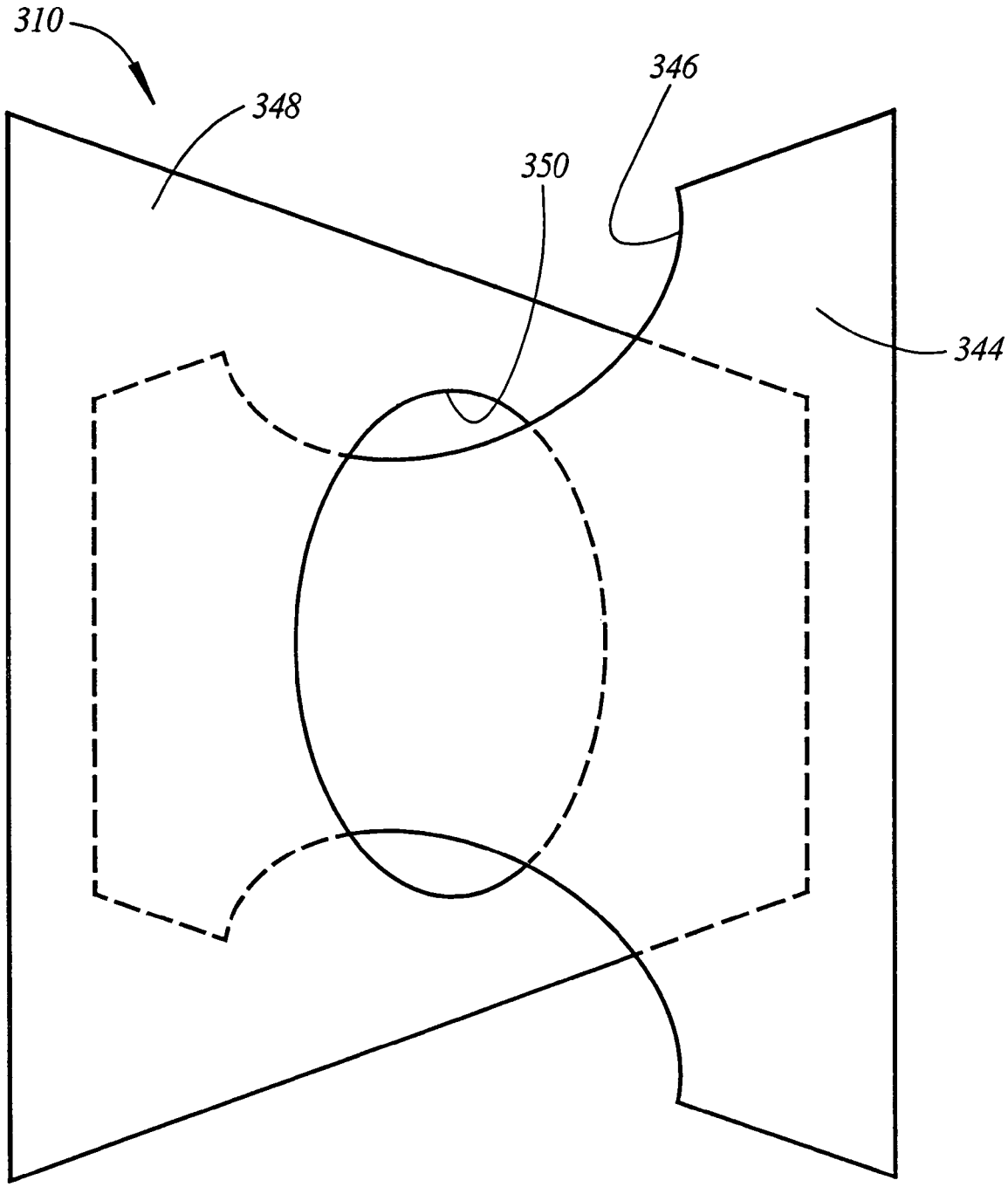
FIG. 6 is a further illustration of the bulk bag of FIG. 5.

Referring to FIGS. 5 and 6, there is shown a bulk bag 310 comprising a third embodiment of the present invention. The bulk bag 310 includes four side walls 312, 314, 316, and 318. The bulk bag 310 further includes a top wall and a bottom wall 322 either of which may be provided with an aperture which receives a fill spout in the case of the top wall or a discharge spout in the case of the bottom wall.

The side walls 312, 314, 316, and 318 of the bulk bag 310 are formed from four side panels 326, 328, 330, and 332. The side panels 326, 328, 330, and 332 are joined one to another at seams 334 each of which is located in a spaced apart relationship to the corners 336 of the bulk bag 310. In the embodiment of the invention illustrated in FIG. 5, the seams 334 are located at points equidistant from adjacent corners 336, however, other configurations can be used in the practice of the invention, if desired.

Each of the side panels 326, 328, 330, and 332 is provided with a baffle 338. Each baffle 338 is secured to its respective side panel at points 340 by sewing. Each baffle 338 is provided with one or more apertures 342 which allow material received in the bulk bag to flow into the corners 336 thereof.

The bulk bag 310 includes a baffle 344 which is sewn into the seams 334 on opposite sides of the bulk bag and extends between the side walls 214 and 218. A baffle 350 is likewise sewn into the seams 334 and extends between the side wall 212 and the side wall 216. As is best shown in FIG. 6, the baffle 344 has an aperture 346 centrally located therein, and the baffle 348 has apertures 350 formed in the upper and lower edges thereof. This allows the baffle 348 to extend through the baffle 344.

In the use of the bulk bag 310, the baffle 344 prevents the side walls 314 and 318 from bulging outwardly when the bulk bag is filled with dense materials. Likewise, the baffle 350 prevents the side walls 312 and 316 from bulging outwardly when the bulk bag is formed with dense materials. In this manner the baffle 344 and 350 maintain the bulk bag 310 in a square or rectangular configuration when the bulk bag is filled with dense materials.

Referring to FIG. 7, there is shown a bulk bag 410 comprising a fourth embodiment of the present invention. The bulk bag 410 includes four side walls 412, 414, 416, and 418. The bulk bag 410 further includes a bottom wall 422 and may include a top wall, although open top bulk bags are known and used. The top wall and/or the bottom wall may be provided with an aperture which receives a fill spout in the case of the top wall or a discharge spout in the case of the bottom wall.

The side walls 412, 414, 416, and 418 of the bulk bag 410 are formed from four side panels 426, 428, 430, and 432. The side panels 426, 428, 430, and 432 are joined one to another at seams 434. As will be appreciated by those skilled in the art, other side wall constructions and configurations can be utilized in the practice of the invention, if desired.

The bulk bag 410 further includes baffles 440 and 442. The baffles 440 and 442 are equal in height to the height of the bulk bag 410 and are substantially equal in length. Each of the baffles 440 and 442 extends between opposite ends 444 and 446. End 444 of the baffle 440 is secured between the side panels 426 and 428 by one of the seams 434. End 446 of baffle 440 is secured between the side panels 428 and 430 by one of the seams 434. End 444 of baffle 442 is secured between the side panels 426 and 432 by one of the seams 434. End 446 of baffle 442 is secured between the side panels 430 and 432 by one of the seams 434. The baffles 440 and 442 are secured one to another along their vertical center lines by a seam 450.

A method of constructing the bulk bag 410 is illustrated in FIGS. 8, 9, and 10. Referring particularly to FIG. 8, the baffles 440 and 442 are positioned in an overlying relationship with the edges 444 and 446 aligned. The seam 450 is next extended along the vertical center lines of the baffles 440 and 442 thereby securing the baffle one to another.

Referring to FIGS. 9 and 10, the baffles 440 and 442 are next folded around the seam 450 to provide four overlapping layers. The four overlapping layers are next dye cut to provide apertures 452 extending through all four layers. Although four circular apertures are illustrated in FIG. 10, the number, geometrical configuration, and size of the apertures 452 is not critical to the practice of the invention.

At the conclusion of the foregoing steps the baffles 440 and 442 are assembled into the bulk bag 410 in the manner illustrated in FIG. 7. As will be appreciated by those skilled in the art, the apertures 452 allow the contents of the bulk bag 410 to flow between the several compartments defined by the baffles 440 and 442, thereby assuring that the bulk bag 410 is uniformly filled. The bulk bag 410 is particularly adapted to receive, store, transport, and discharge dense materials, for example, coinage of the type circulated at currency.

It will therefore be understood that the bulk bag 410 comprises four side walls which are joined together end to end to define a rectangular enclosure having four corners. The rectangular enclosure is further characterized by a center line extending parallel to the side walls of the bulk bag and located equidistant from each of the corners characterizing the rectangular enclosure. Four baffle portions extend inwardly from the sides of the rectangular enclosure and are joined together at the center line. Each of the baffle portions has at least one aperture formed therethrough to facilitate the flow of dense materials within the bulk bag.

The bulk bag 410 is further characterized by two baffle segments each having opposed ends. The opposed ends of the first baffle segment are secured at the centers of the first and second side walls of the rectangular enclosure, and the baffle segment extends inwardly therefrom to the center line. The opposed ends of the second baffle segment are secured at the center of the third and fourth corners of the rectangular enclosure, and the baffle segment extends inwardly therefrom to the center. The baffle segments are seamed together at the center line.

Figure 11:
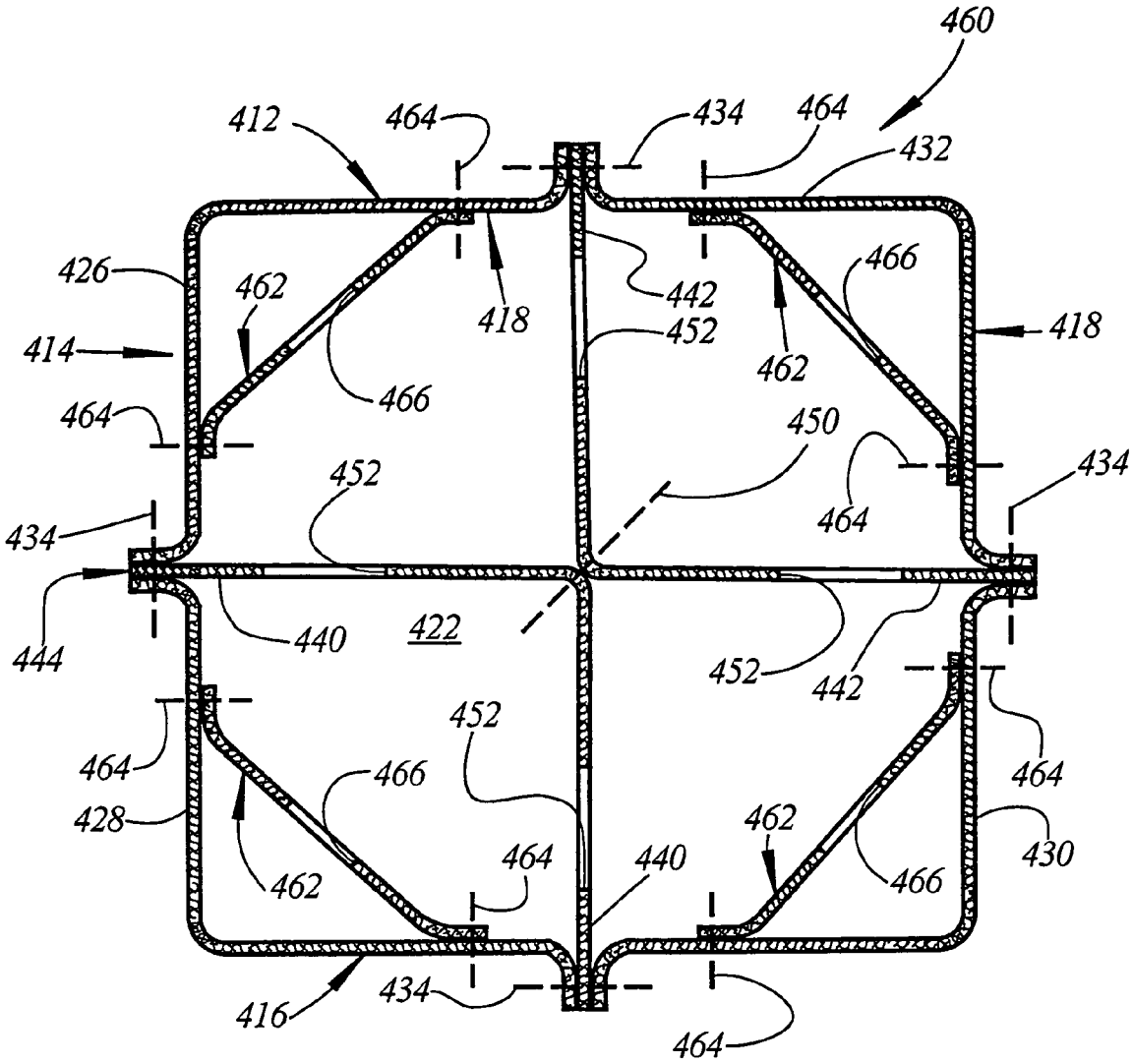
FIG. 11 is a view similar to FIG. 7 illustrating a variation of the fourth embodiment of the invention.

Referring to FIG. 11, there is shown a bulk bag 460 comprising a variation of the fourth embodiment of the invention as illustrated in FIG. 7 and described hereinabove in connection therewith. The bulk bag 460 is substantially identical in construction and function to the bulk bag 410, except that the bulk bag 460 is provided with four baffles 462 extending across the corners of the bulk bag 460. Each of the baffles 462 is secured in place by seams 464. Each of the baffles 462 is provided with one or more apertures 466 to facilitate the flow of dense materials within the bulk bag 460.

Figure 12:
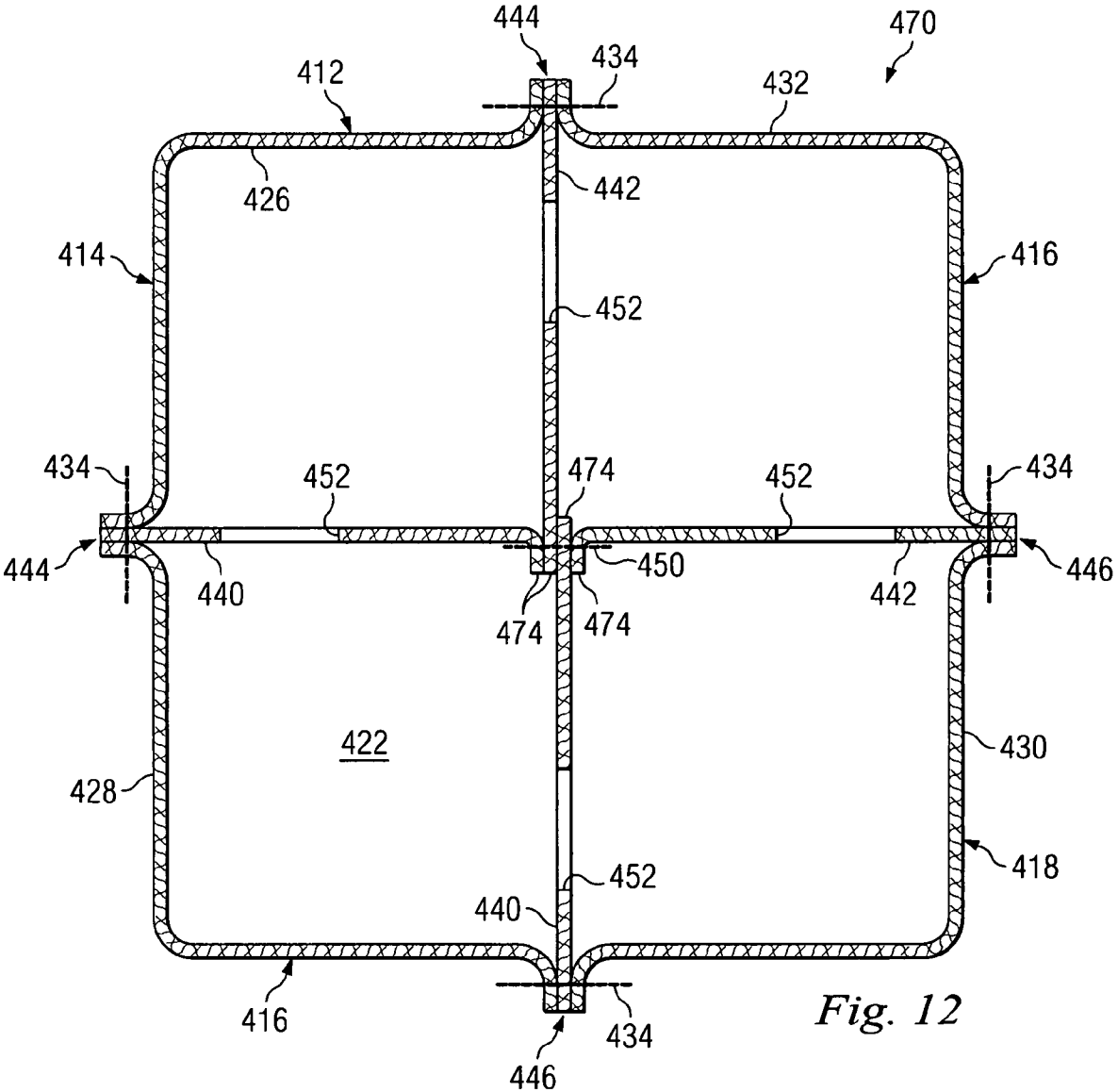
FIG. 12 is a transverse sectional view of a bulk bag comprising a further variation of the fourth embodiment of the invention.

Referring to FIG. 12, there is shown a bulk bag 470 comprising a variation of the fourth embodiment of the invention as illustrated in FIG. 7 and described hereinabove in connection therewith. The bulk bag 470 is substantially identical in construction and function to the bulk bag 410, except that the bulk bag 470 comprises four baffle segments having ends 474 defining the compartments of the bulk bag. The baffle segments are seamed together at the center line.

Figure 13:
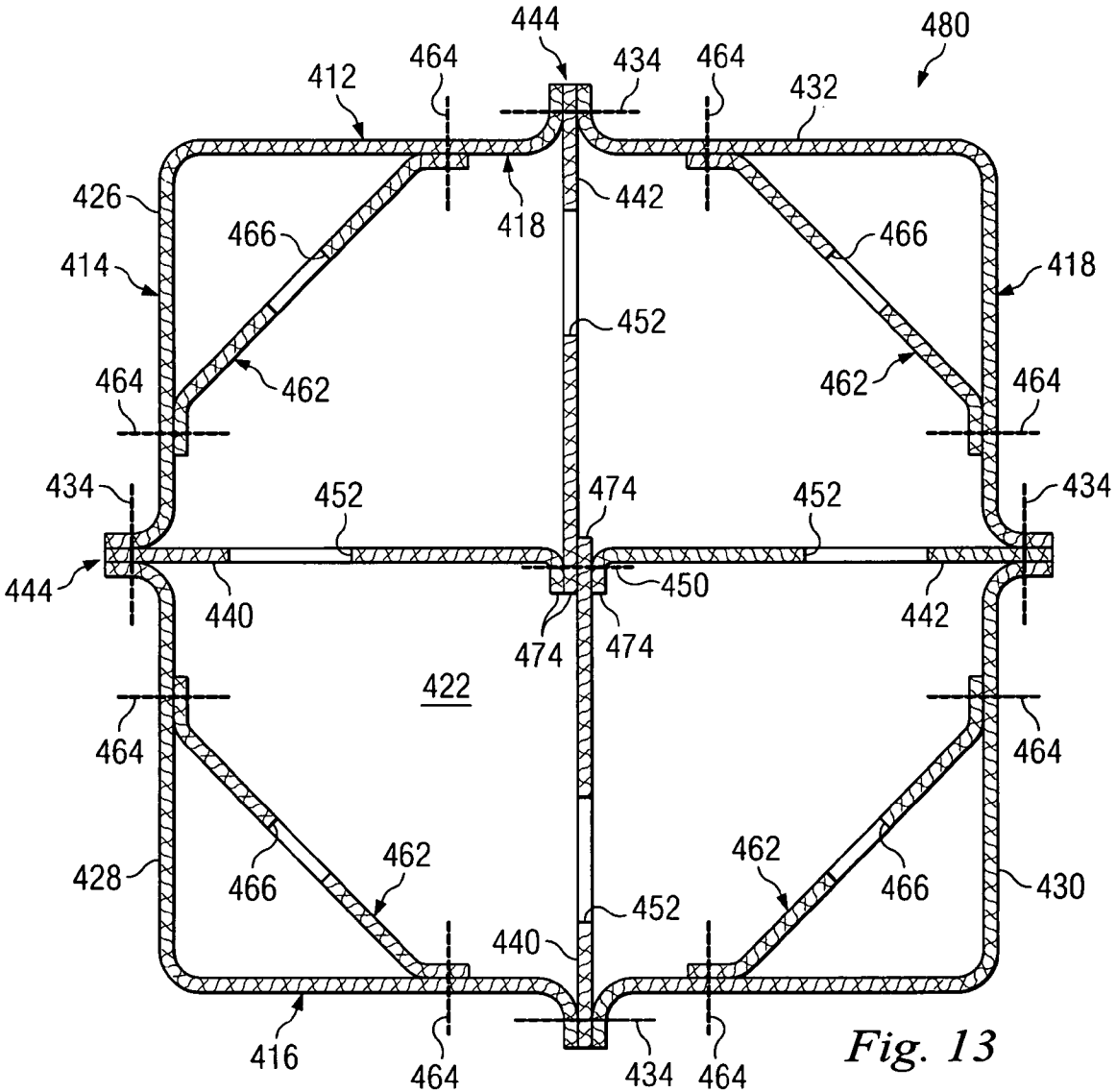
FIG. 13 is a view similar to FIG. 12 illustrating a still further variation of the fourth embodiment of the invention.

Referring to FIG. 13, there is shown a bulk bag 480 comprising a variation of the bulk bag 470 illustrated in FIG. 12 and described hereinabove in connection therewith. The bulk bag 480 is substantially identical in construction and function to the bulk bag 470, except that the bulk bag 480 is provided with four baffles 462 extending across the corners of the bulk bag 480.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A bulk bag for dense materials comprising:

four side panels each having a top, a bottom, and opposed ends;

the four side panels being seamed together end to end to define a rectangular enclosure characterized by four corners;

a bottom wall seamed to the bottoms of the side panels;

four baffles each comprising a baffle portion and each having opposed ends, wherein a first of the opposed ends of each baffle is secured to a seam of a respective one of the four side panels and a second of the opposed ends of each of the four baffles are seamed together at a center line; and four apertures each formed through the baffle portions of two of the four baffles to facilitate the distribution of dense materials within the bulk bag.

2. The bulk bag for dense materials according to claim 1, wherein the four side panels are characterized by a predetermined height comprising the distance from the bottom wall to the tops of the side walls, and wherein the baffles are characterized by a predetermined height which is substantially equal to the predetermined height of the side walls.

3. A bulk bag for dense materials comprising:

four side panels each formed from woven fabric;

the four side panels being seamed together end to end to define a rectangular enclosure characterized by four corners;

the rectangular enclosure being further characterized by a center line extending parallel to the side panels and located equidistant from each of the four corners;

four baffles each comprising a baffle portion and opposed ends;

the first of the opposed ends of each baffle being secured to the ends of two side panels of the bulk bags;

the second of the opposed ends of each of the baffles being seamed together at the center line; and four apertures each formed through the baffle portions of two of the four baffles to facilitate the distribution of dense materials within the bulk bag.

4. The bulk bag for dense materials according to claim 3, wherein the four side panels are characterized by a predetermined height comprising the distance from the bottom wall to the tops of the side panels, and wherein the baffles are characterized by a predetermined height which is substantially equal to the predetermined height of the side panels.

5. The bulk bag for dense materials according to claim 4 further including additional baffles extending across the corners of the bulk bag.

* * * * *